United States Patent [19]

Wakabayashi et al.

[11] Patent Number: 4,780,700

[45] Date of Patent: Oct. 25, 1988

[54] NOISE PREVENTION HIGH VOLTAGE RESISTIVE WIRE AND METHOD OF MANUFACTURING THE SAME

[75] Inventors: Seiichi Wakabayashi; Yoshiaki Yamakoshi, both of Shizuoka, Japan

[73] Assignee: Yazaki Corporation, Japan

[21] Appl. No.: 73,099

[22] Filed: Jul. 14, 1987

[30] Foreign Application Priority Data

Jul. 14, 1986 [JP] Japan ..... 61-163732

[51] Int. Cl.[4] ..... H01C 7/00

[52] U.S. Cl. ..... 338/66

[58] Field of Search ..... 338/66; 174/74 R, 35 C, 174/75 R

[56] References Cited

U.S. PATENT DOCUMENTS 3,813,643 5/1974 Hartz ..... 338/66 X

FOREIGN PATENT DOCUMENTS 4419721 8/1969 Japan .

*Primary Examiner*—E. A. Goldberg
*Assistant Examiner*—Marvin M. Lateef
*Attorney, Agent, or Firm*—Wigman & Cohen

[57] ABSTRACT

To prevent generation of corona discharge at terminals of high voltage resistive wires used as ignition cords, a metallic cap is fixed to at least one exposed core wire end by a bonding agent, and further a metallic terminal is fitted to the metallic cap and caulked to the metallic cap and the insulating material simultaneously. The core wire end is thereby sufficiently buried in the bonding agent and protected by the terminal.

10 Claims, 2 Drawing Sheets

NOISE PREVENTION HIGH VOLTAGE RESISTIVE WIRE AND METHOD OF MANUFACTURING THE SAME

BACKGROUND OF THE INVENTION

1. Field of the Invention

The present invention relates to a noise prevention high voltage resistive wire used as ignition cords for automotive vehicles, and more specifically to an improvement of the resistive wire including terminals attached thereto.

2. Description of the Prior Art

In ignition cords used for an automotive vheicle, conventionally, the cord wire is a conductor made of a material having a high resistance such as nonmetal; the core wire is covered by an insulating material; and two metallic terminals are fixed to both free ends of the resistive wire.

The ignition cord is usually used for conducting high voltage large pulse current from a distributer to ignition plugs, and therefore, the metallic terminals are formed into a cylindrical shape so as to be appropriately connectable to ignition plugs.

FIG. 1 shows an example of prior art noise prevention high voltage resistive wires in which the reference numeral 1 denotes a high voltage resistive wire; and 2 denotes a metallic terminal 2, and 3 denotes a conductive bonding agent 3. The resistive wire 1 includes an insulating material 1*a* and a core wire 1*b*; the terminal 2 includes two caulking tabs 2*a* and a radial plate 2*b*. The terminal 2 is connected to the resistive wire 1 by caulking the two caulking tabs 2*a* onto the outer surface of the resistive wire 1 in such a way that the core wire 1*b* is in contact with the radial plate 2*b* of the terminal 2. This radial plate 2*b* is effective to secure the contact between the terminal 2 and the core wire 1*b* while increasing the contact area between the two, when the terminal 2 is fixed to the resistive wire 1. Further, in FIG. 1, an exposed end of the core wire 1*b* is bent into a hook shape so as to be sandwiched between the outer surface of the insulating material 1*a* and the inner surface of the terminal 2.

In the resistive wire as described above, however, corona discharge will readily be generated at the metallic terminals due to unstable contact between the terminal and the core wire, when a high voltage large current flows therethrough, thus often resulting in a burning trouble due to corona discharge. To overcome this problem, a method has been proposed by which a conductive bonding agent is first applied to an end of the core wire 1*b* and then the terminal 2 is fitted to the resistive wire 1 to bond the core wire end to the radial plate 2*b*.

Recently, however, there exists a tendency toward a higher ignition voltage in proportion to higher engine compression ratio with increasing engine performance in automotive vehicles. Therefore, there still exists a problem in that corona discharge is often generated at the terminals of the resistive wire. In addition, where heat-cool cycle is repeated and further vibration is applied to the resistive wire, small gaps inevitably remaining at the bonding area will inevitably produce cracks thereat, thus resulting in partial peeling-off of the bonding agent and further resistive wire burning trouble.

SUMMARY OF THE INVENTION

With these problems in mind, therefore, it is the primary object of the present invention to provide a noise prevention high voltage resistive wire provided with terminals of high reliability.

The other object of the present invention is to provide a method of manufacturing a noise prevention high voltage resistive wire, which can prevent terminal trouble induced when a high voltage large pulse current is passed therethrough.

To achieve the above-mentioned object, the noise prevention high voltage resistive wire according to the present invention comprises: (a) a high voltage resistive core wire covered by an insulating material; (b) at least one metallic cap bonded to at least one exposed core wire end with a conductive bonding agent put in said metallic cap; and (c) at least one metallic terminal fitted to at least one end of the resistive wire to which said metallic cap is bonded.

The metallic cap is cylindrical in shape and further fixed to one end of the insulating material by caulking. The metallic terminal is fixed to the metallic cap and further one end of the insulating material by caulking. That is, the metallic terminal is formed with a first tab caulked to the metallic cap and a second tab caulked to the insulating material of the resistive wire.

To achieve the above-mentioned object, a method of manufacturing a noise prevention high voltage resistive wire having a core wire and an insulating material, according to the present invention, comprises the following steps of: (a) removing the insulating material from at least one end of the resistive wire to expose at least one end of the core wire; (b) putting a conductive bonding agent into a metallic cap; (c) fitting the metallic cap to at least one end of the resistive wire at which the core wire end is exposed; (d) fitting a metallic terminal to the metallic cap fitted to the resistive wire; and (e) caulking the metallic cap to the insulating material and the metallic terminal to the metallic cap and the insulating material simultaneously.

When the bonding agent is a thermosetting resin, the bonding agent is hardened after the metallic cap has been fitted and caulked to one end of the resistive wire or after the metallic cap and the metallic terminal have both been caulked.

In the noise prevention high voltage resistive wire according to the present invention, since the core wire is sufficiently buried in the conductive bonding agent, it is possible to prevent gaps or cracks from being produced in the bonding agent, thus maintaining a stable contact condition between the core wire and the terminal for long period 10 times as long as the life of the prior art resistive wire.

BRIEF DESCRIPTION OF THE DRAWINGS

The features and advantages of the noise prevention high voltage resistive wire according to the present invention will be more clearly appreciated from the following description taken in conjunction with the accompanying drawings in which like reference numerals designate the same or similar elements throughout the figures thereof and in which:

FIG. 2(*a*) is a cross-sectional view showing a resistive wire having an exposed core wire end and a metallic cap including a bonding agent therein;

FIG. 2(*b*) is a cross-sectional view showing a state where the metallic cap and the resistive wire are bonded to each other;

FIG. 2(*c*) is a cross-sectional view showing a state where the metallic terminal is caulked to the resistive wire, which illustrates a first embodiment of the noise prevention high voltage resistive wire according to the present invention.

DETAILED DESCRIPTION OF THE PREFERRED EMBODIMENTS

A noise prevention high voltage resistive wire and the method of manufacturing the same will be described in further detail hereinbelow with reference to the attached drawings.

Figure 1:
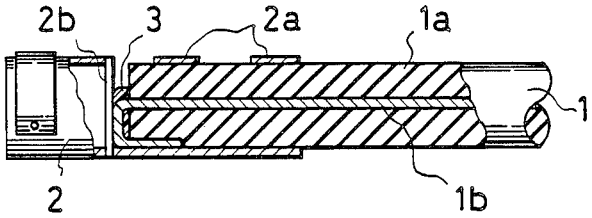
FIG. 1 (PRIOR ART)
FIG. 1 is a partially broken cross-sectional view showing an example of prior-art noise prevention high voltage resistive wires.
Figure 2A:
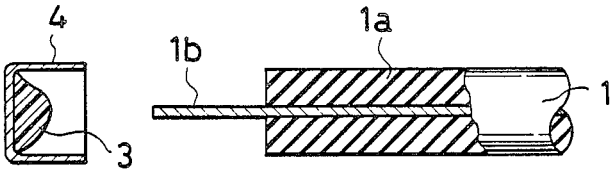
FIGS. 2(*a*), (*b*) and (*c*) are partially broken cross-sectional views for assistance in explaining the procedure in manufacturing a noise prevention high voltage resistive wire of the present invention.
Figure 2B:
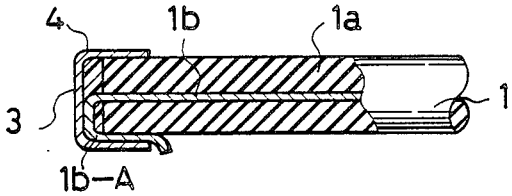
Figure 2C:
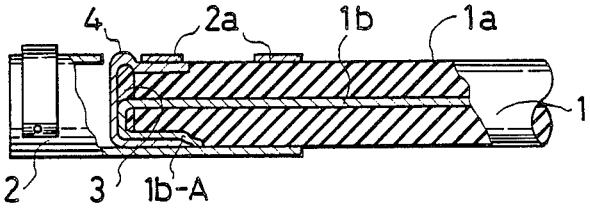

FIG. 2(*c*) shows a resistive wire provided with a metallic terminal at one end thereof. The resistive wire 1 of the present invention is made up of an insulating material 1*a* and a core wire 1*b*, a metallic terminal 2 having two caulking tabs 2*a*, and, in particular, a metallic cap 4. The metallic cap 4 is bonded to an cut-off end of the insulating material 1*a* by a bonding agent 3 with an exposed core wire end 1*b*-A sandwiched between the outer surface of the insulating material 1*a* and the inner surface of the metallic cap 4; while the metallic terminal 2 is fixed to the metallic cap 4 and the insulating material 1*a* by caulking the two caulking tabs 2*a*, simultaneously.

The core wire 1*b* is a nonmetallic resistive conductor obtained by coating a composite including conductive carbon onto nonmetallic fiber. This core wire 1*b* is covered by an insulating material 1*a* in accordance with the conventional method.

The metallic cap 4 is preferably cylindrical in shape, an inner diameter of which a little larger than an outer diameter of the insulating material 1*a*. This cap 4 is first fitted to the insulating material 1*a* as shown in FIG. 2(*b*) and then caulked thereto as shown in FIG. 2(*c*).

The bonding agent 3 for fixing the metallic cap 4 to the insulating material 1*a* and the core wire 1*b* is preferably of paste or gel type, which can be obtained by mixing conductive material such as conductive carbon fiber, or metallic whisker with a thermosetting liquid resin. The usable thermosetting liquid resin is single-liquid heat hardened resin or two-liquid room temperature hardened resin. The bonding structure is of either hard resin type or soft rubber type after hardened. However, it is essential that the bonding agent has a strong adhesive force to metal and nonmetallic resistive conductor (core wire).

The method of manufacturing the resistive wire according to the present invention will be described hereinbelow with reference to FIGS. 2(*a*) to (*c*).

As depicted in FIG. 2(*a*), one end of the core wire 1*b* is exposed by removing a part of the insulating material 1*a*, and an appropriate amount of the bonding agent 3 is put into the metallic cap 4. Thereafter, the exposed end of the core wire 1*b* is bend into hook shape 1*b*-A, and the metallic cap 4 is fitted to the end of the resistive wire 1, as depicted in FIG. 2(*b*). In this case, it is also possible to fit the metallic cap 4 to the resistive wire 1 without bending the core wire 1*b*. Then, the metal terminal 2 is further fitted to the metallic cap 4 and the resistive wire 1 and fixed to them by caulking the two caulking tabs 2*a*. By doing this, one caulking tab 2*a* (leftward in FIG. 2(*c*) is caulked to the insulating material 1*a* via the metallic cap 4, while the other caulking tab 2*a* (rightward in FIG. 2(*c*) is directly caulked to the material 1*a*, so that the metallic cap 4 and the terminal 2 are fixed to the resistive wire 1 simultaneously in a single caulking process, as shown in FIG. 2(*c*). The caulked resistive wire 1 is then heated to harden the bonding agent 3.

In the above process, it is also possible to first fit the metallic cap 4 to the resistive wire 1, immediately caulk the cap 4 to the wire 1, heat the wire 1 to harden the bonding agent 3, and lastly fit and caulk the terminal 2 to the metal cap 4 and the resistive wire 1. Further, when the conductive bonding agent 3 is of room temperature hardened type, it is of course unnecessary to heat the bonding agent.

In the noise prevention high voltage resistive wire of the present invention thus manufactured, since the core wire is perfectly buried in the conductive bonding agent, no gap will be produced due to vibration, and an excellent bonding condition will be maintained between the metallic cap and the core wire, it thus being possible to lengthen the life of the resistive wire as long as 10 times longer than that of the prior art resistive wire, without degrading the ignition characteristics at all.

EXAMPLE 1

The core wire of nonmetallic conductor was manufactured by extrusion coating a conductive addition reaction silicon composite onto a 0.6 mm-dia. reinforcement core wire made of aramid fiber so that an outer diameter thereof became 1.3 mm; the core wire was further coated by silicon rubber and braided by glass fiber; further a silicon rubber insulating coat was covered to prepare a 7 mm-dia. high voltage resistive wire.

A metallic cap with a diameter of about 7.3 mm and an axial length of 5 mm was prepared by pressing a brass plate.

On the other hand, an epoxy resin composite including about 25% conductive carbon powder was prepared as the conductive bonding agent.

In accordance with the procedure shown in FIG. 2, the resistive core wire was bent into a hook shape 1*b*-A as shown; an end of the resistive wire was inserted into the metallic cap to which the bonding agent was inserted; further the cylindrical metallic terminal was fitted to the metallic cap and caulked thereto. Under these conditions, the metallic cap was simultaneously fixed to an end of the resistive wire, and a small amount of conductive bonding agent was overflowed from a gap formed between the metallic cap and the outer surface of the insulating material.

Thereafter, the whole wire was heated for hardening the bonding agent to obtain a completed noise prevention high voltage resistive wire.

EXAMPLE 2

The high-voltage resistive wire, the metallic cap and the conductive bonding agent same as in Embodiment 1 were prepared.

Figure 3:
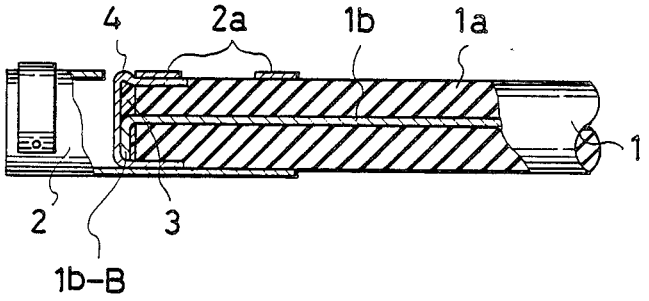
FIG. 3 is a partially broken cross-sectional view illustrating a second embodiment of the noise prevention high voltage resistive wire according to the present invention.

Without bending the core wire, an end of the high voltage resistive wire was inserted into the metallic cap in which the bonding agent was put; the resistive core wire was bent into a shape 1*b*-B as shown in FIG. 3; the metallic cap was slightly caulked and then heated to harden the conductive bonding agent. Thereafter, the metallic terminal the same as in Embodiment 1 was fitted to the cap to obtain a completed noise prevention high voltage resistive wire.

According to the present invention, since an end of an exposed resistive core wire of a high voltage resistive wire is pushed into bonding agent before hardening and then hardened within the metallic cap, the work is simple and bonding force is sufficiently strong. Therefore, no gap remains in the bonding portion; the bonding area is broad; and the bonding agent is protected by the metallic cap without directly being subjected to an external force applied to the metal terminal. Therefore, peeling-off trouble will not be readily produced even when the terminal is subjected to vibration or repeated thermal hysteresis, thus obtaining a noise prevention high voltage resistive wire of high reliability and therefore long life without burning trouble at the terminal portions.

What is claimed is:

1. A noise prevention high voltage resistive wire, comprising:

(a) a high voltage resistive core wire covered by an insulating material;

(b) at least one metallic cap bonded to at least one exposed core wire end with a resin conductive bonding agent put in said metallic cap, said metallic cap being further fixed by caulking to the insulating material of said one end of the core wire, whereby said cap is fixed to said wire by both the resin bonding agent and said caulking; and (c) at least one metallic terminal fitted to at least one end of the resistive wire to which said metallic cap is bonded.

2. The noise prevention high voltage resistive wire as set forth in claim 1, wherein said metallic cap is cylindrical in shape.

3. The noise prevention high voltage resistive wire as set forth in claim 1, wherein said metallic terminal is fixed to said metallic cap and near one end of the insulating material by caulking.

4. The noise prevention high voltage resistive wire as set forth in claim 3, wherein said metallic terminal is formed with a first tab caulked to said metallic cap and a second tab caulked to the insulating material of the resistive wire.

5. The noise prevention high voltage resistive wire as set forth in claim 1, wherein the conductive bonding agent is a thermosetting one-liquid resin.

6. The noise prevention high voltage resistive wire as set forth in claim 1, wherein the conductive bonding agent is a room temperature hardened two-liquid resin.

7. A method of manufacturing a noise prevention high voltage resistive wire having a core wire and an insulating material, which comprises the following steps of:

(a) removing the insulating material from at least one end of the resistive wire to expose at least one end of the core wire;

(b) putting a resin conductive bonding agent into a metallic cap;

(c) fitting the metallic cap to at least one end of the resistive wire at which the core wire end is exposed;

(d) fitting a metallic terminal to the metallic cap fitted to the resistive wire; and (e) caulking the metallic cap to the insulating material and the metallic terminal to the metallic cap and the insulating material simultaneously, whereby the metallic cap is fixed to said one end of the core wire by both said resin bonding agent and said caulking.

8. The method as set forth in claim 7, wherein when the bonding agent is a thermosetting resin, the bonding agent is hardened after the metallic cap has been fitted and caulked to one end of the resistive wire.

9. The method as set forth in claim 7, wherein when the bonding agent is a thermosetting resin, the bonding agent is hardened after the metallic cap and the metallic terminal have both been caulked.

10. The method as set forth in claim 7, wherein the exposed core wire end is bent into a hook shape so that a free end thereof is in contact with an outer surface of the insulating material.

* * * * *